US006691436B2

(12) United States Patent
Chizek, Sr.

(10) Patent No.: US 6,691,436 B2
(45) Date of Patent: Feb. 17, 2004

(54) HAND-HELD DEVICE FOR EXPOSING BURIED OBJECTS

(76) Inventor: Franklin J. Chizek, Sr., 500 Shannon Rd., Papillion, NE (US) 68046

( * ) Notice: Subject to any disclaimer, the term of this patent is extended or adjusted under 35 U.S.C. 154(b) by 0 days.

(21) Appl. No.: 09/894,451

(22) Filed: Jun. 28, 2001

(65) Prior Publication Data

US 2003/0000744 A1 Jan. 2, 2003

(51) Int. Cl.[7] ..... E02F 3/88
(52) U.S. Cl. ..... 37/322; 37/323; 175/67
(58) Field of Search ..... 37/321, 322, 323, 37/335; 175/67

(56) References Cited

U.S. PATENT DOCUMENTS 4,302,052 A * 11/1981 Fischer ..... 175/67
4,412,394 A * 11/1983 Coker ..... 37/318
4,776,731 A * 10/1988 Briggs et al. ..... 15/409
4,936,031 A * 6/1990 Briggs et al. ..... 37/189
5,140,759 A * 8/1992 Artzberger ..... 137/874
5,212,891 A * 5/1993 Schuermann et al. ..... 241/1
5,887,667 A * 3/1999 Van Zante et al. ..... 175/218
6,000,151 A * 12/1999 Hayes ..... 175/67

* cited by examiner

*Primary Examiner*—Robert E. Pezzuto
*Assistant Examiner*—Meredith Petravick
(74) *Attorney, Agent, or Firm*—Thomte, Mazour & Niebergall; Dennis L. Thomte

(57) ABSTRACT

A hand-held wand is disclosed for exposing buried objects such as utility lines or the like. The wand comprises an elongated, hollow tube having upper and lower ends with first and second water supply conduits being positioned adjacent the exterior surface of the tube. The lower end of the first water supply conduit has a digging nozzle mounted thereon. The lower end of the second water supply conduit extends upwardly into the lower end of the tube to create a vacuum or suction within the lower end of the hollow tube to remove muddy water from the hole being dug. A two-way valve is connected to the upper ends of the first and second water supply lines for alternately delivering water to the water supply conduits. The intake side of the two-way valve is in fluid communication with a source of high pressure water. The upper end of the hollow tube has a mud take-off hose connected thereto which may be utilized to convey the muddy water to a location remote from the hole being dug or to a container.

18 Claims, 4 Drawing Sheets

HAND-HELD DEVICE FOR EXPOSING BURIED OBJECTS

BACKGROUND OF THE INVENTION

1. Field of the Invention

This invention relates to a hand-held device for exposing buried objects such as gas lines, sewer lines, telephone lines, and television cables.

2. Description of the Related Art

With the present-day increase in the use of fiber optic cables, there has been a proliferation of horizontal boring machines which are utilized to lay the cables. The horizontal boring machines enable contractors to lay cables under parking lots, highways, and other utilities without disturbing them. While horizontal boring machines are extremely accurate, their biggest advantage is that of estimating the depth of the boring equipment. While all intersecting utility lines are generally marked with paint on the surface, there are usually inaccuracies in the depth given by the utility company. The inaccuracies described above may result in the intersecting utility being "in harm's way." This has resulted in the interruption of m utility services wherein gas lines were drilled, sewer lines were drilled, as well as telephone lines and television cables.

Accidents have become so frequent that it has become necessary to expose the utility lines prior to making the horizontal bore. The utility lines have been exposed by digging a hole in the ground. At first these holes were hand-dug, which is time-consuming and not without accidents. Such accidents caused the horizontal boring industry to solicit help from the sewer cleaning industry. Hydro-jetting trucks were used to loosen the soil in the hole and vacuum trucks were used to suction up the mud thus produced. While this does a good job, it requires two very expensive pieces of equipment as well as two operators to operate the same. The next generation of pot-holers or day-lighters, was a jet/vac trailer. The jet/vac trailer has a small hydro-jetting machine on the front of the trailer and a small vacuum or suction tank on the rear of the trailer. While this is less expensive, it still requires two operators. The mud thus produced and collected is usually disposed of at the sewer waste treatment plant which normally charges for the disposal.

SUMMARY OF THE INVENTION

A hand-held device is disclosed for exposing buried objects such as utility lines or cables. The device is comprised of an elongated, hollow tube having upper and lower ends with first and second water supply conduits positioned adjacent the tube. Each of the water supply conduits has an intake end and a discharge end. The discharge end of the first water supply conduit is positioned adjacent the lower end of the tube and has a digging nozzle mounted thereon. The discharge end of the second water supply line is directed upwardly into the tube adjacent the lower end thereof. A mud take-off conduit is in fluid communication with the upper end of the tube. A two-way valve is positioned adjacent the upper end of the tube and has intake and discharge sides. The discharge side of the valve is in fluid communication with the intake ends of the first and second water supply conduits. The intake side of the valve is in fluid communication with a high pressure water pump.

In use, water is directed downwardly through the first fluid conduit and is discharged from the cutting nozzle to loosen dirt in the hole being dug above the utility line or cable. When the hole becomes full of mud, the two-way valve is switched so that water is directed downwardly through the second water conduit and thence upwardly into the lower end of the tube to create a suction therein so that the mud in the hole is vacuumed or sucked upwardly therethrough into the mud take-off conduit which may be in fluid communication with a mud collection container or the like.

It is therefore a principal object of the invention to provide a hand-held device for exposing buried objects such as utility lines or cables.

Still another object of the invention is to provide a hand-held device for exposing buried objects which may be operated by one person.

Still another object of the invention is to provide a hand-held device for exposing buried objects wherein water is used to dig a hole in the ground above the object being exposed with the mud created by the drilling operation being vacuumed out of the hole.

A further object of the invention is to provide a hand-held device for exposing buried objects which is economical of manufacture, refined in appearance, and durable in use.

These and other objects will be apparent to those skilled in the art.

DESCRIPTION OF THE PREFERRED EMBODIMENT

Figure 1:
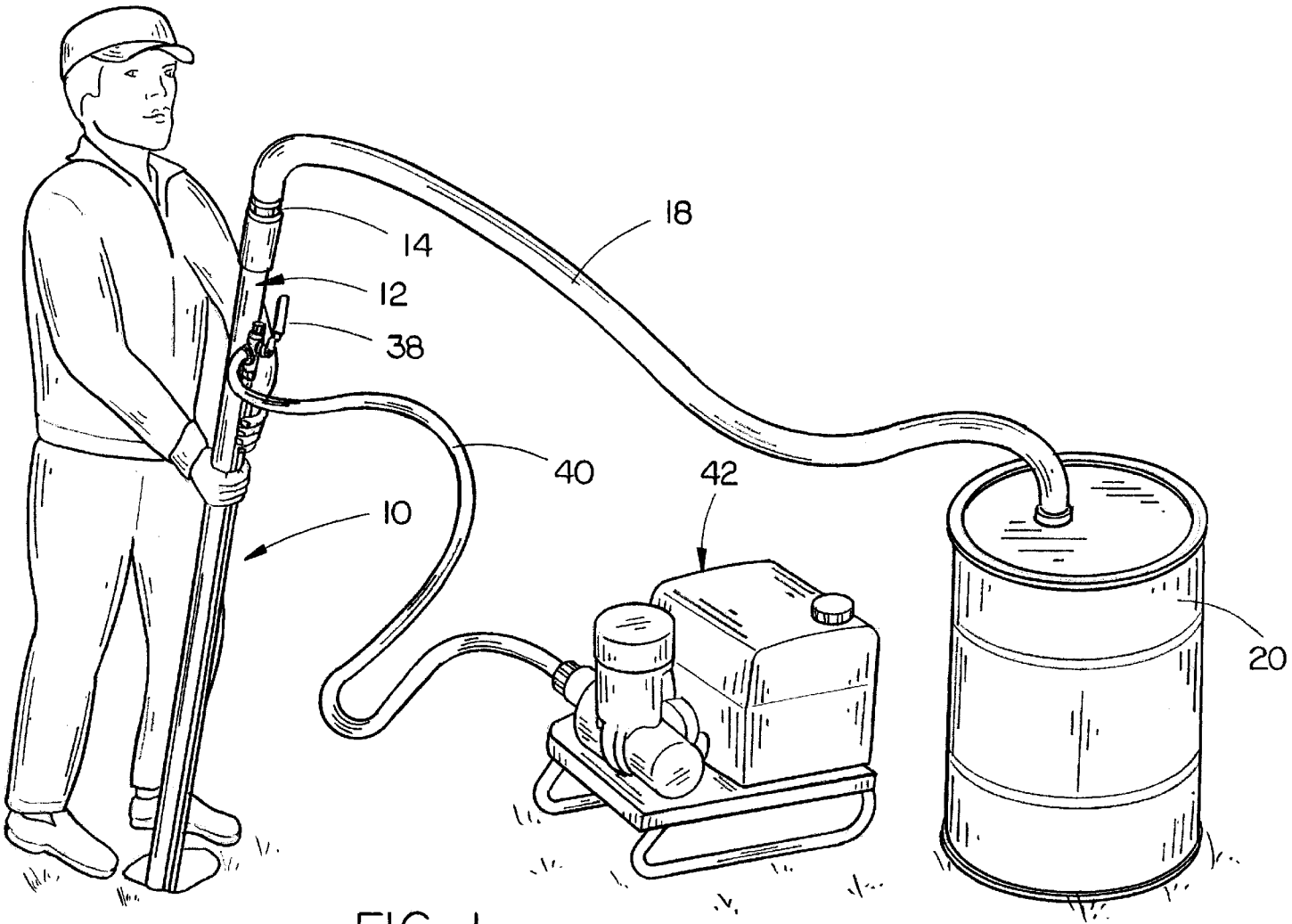
FIG. 1 is a perspective view illustrating an operator using the hand-held device of this invention.
Figure 2:
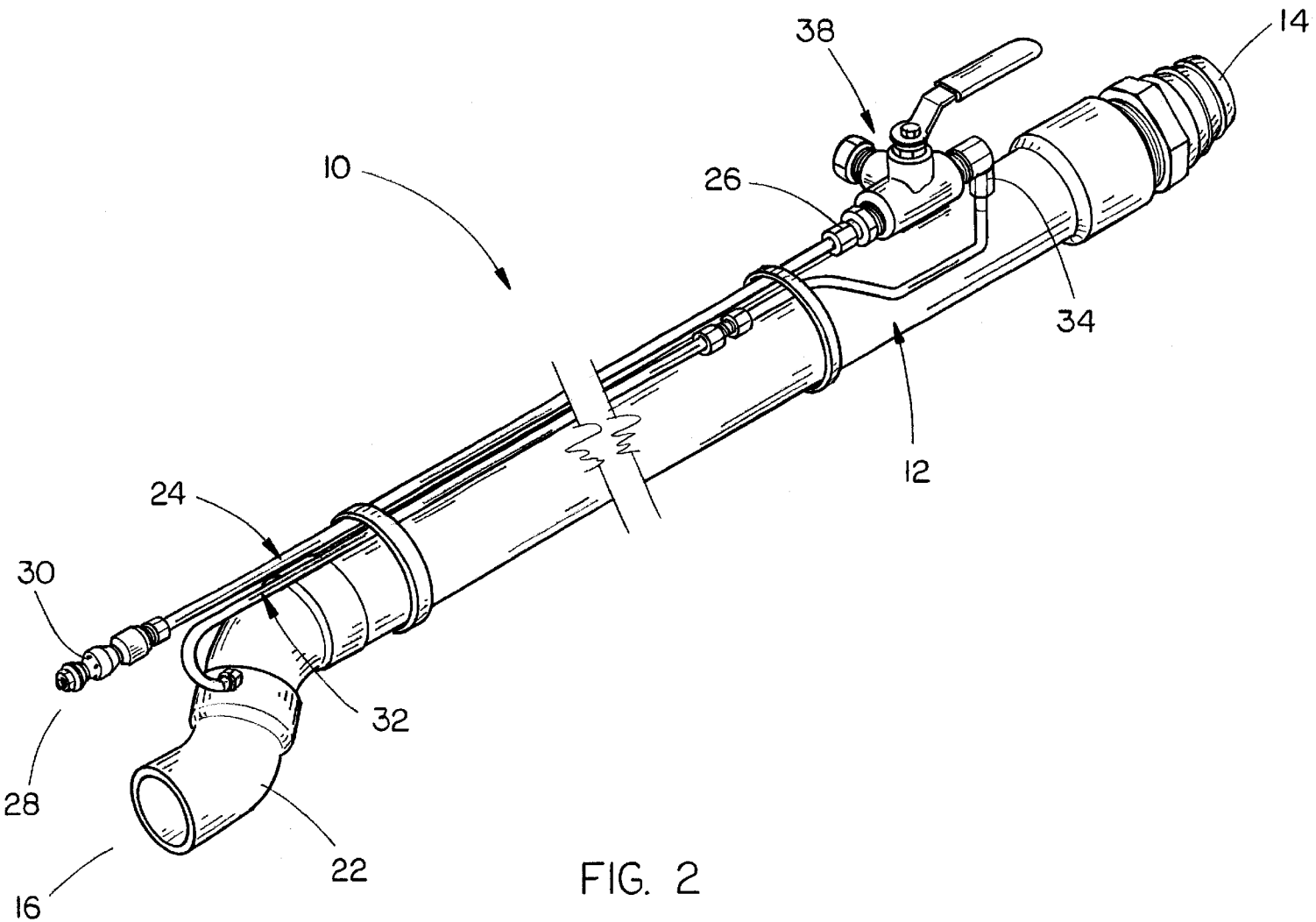
FIG. 2 is a partial perspective view of the device of this invention.

In the drawings, the numeral 10 refers to the hand-held device of this invention. Device 10 includes an elongated hollow plastic tube 12 having an upper end 14 and a lower end 16. Preferably, the tube 12 is comprised of a rigid plastic material. A mud take-off hose 18 is operatively connected to the upper end 14 of the tube 12 and is in communication with a mud collection container 20. The container 20 is optional since the hose 18 could be used to simply spray the mud onto the ground surface rather than collecting the same. The tube 12 is provided with an offset portion 22, as seen in the drawings.

A first water conduit 24 is positioned adjacent the exterior surface of tube 12 and has an upper end 26 and a lower end 28. A conventional, spinning discharge or cutting nozzle 28 is mounted on the lower end of the conduit 24 so as to be positioned laterally of the lower end 16 of tube 12. A second water supply line 32 is positioned adjacent the exterior surface of the tube 12 and has an upper end 34. The lower end of conduit 32 is directed upwardly into the lower end portion 22 and has a nozzle 36 positioned thereon which is centrally located with respect to the center axis of the tube 12.

A two-way valve 38 has its discharge sides in fluid communication with the upper ends of the water conduits 24 and 32. A water supply hose 40 extends from the intake side of the two-way valve 38 to a source of water under high pressure such as a jetter pump 42.

Figure 3:
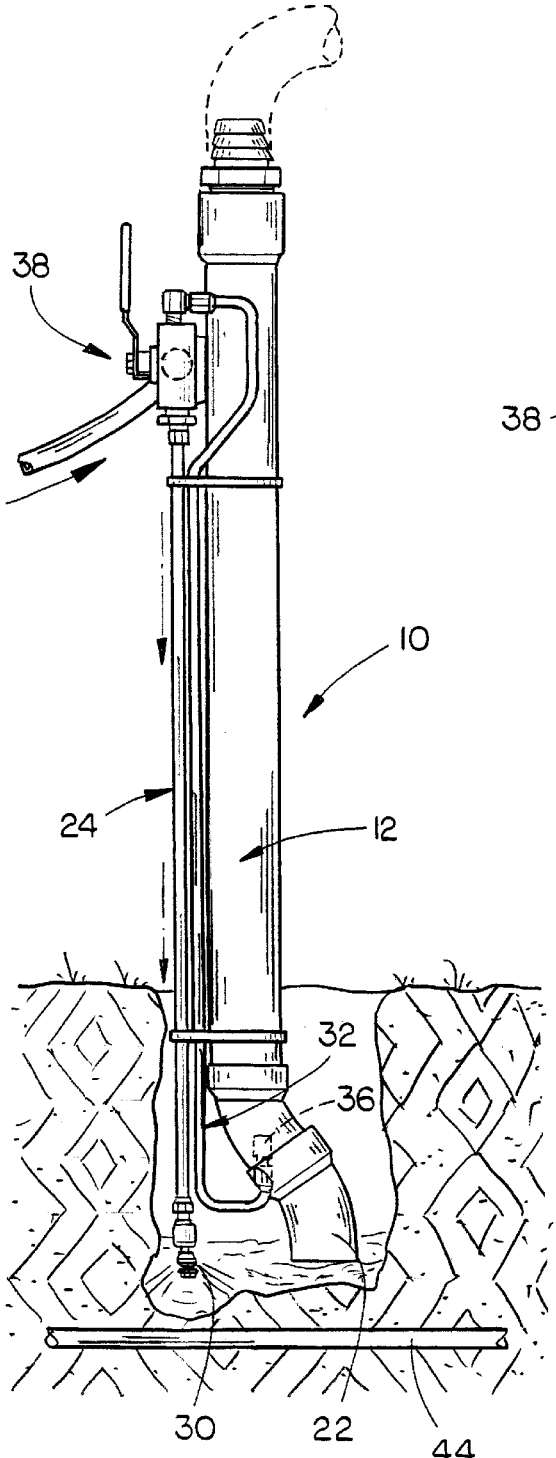
FIG. 3 is a side view illustrating the device of this invention being used to expose a utility line.
Figure 4:
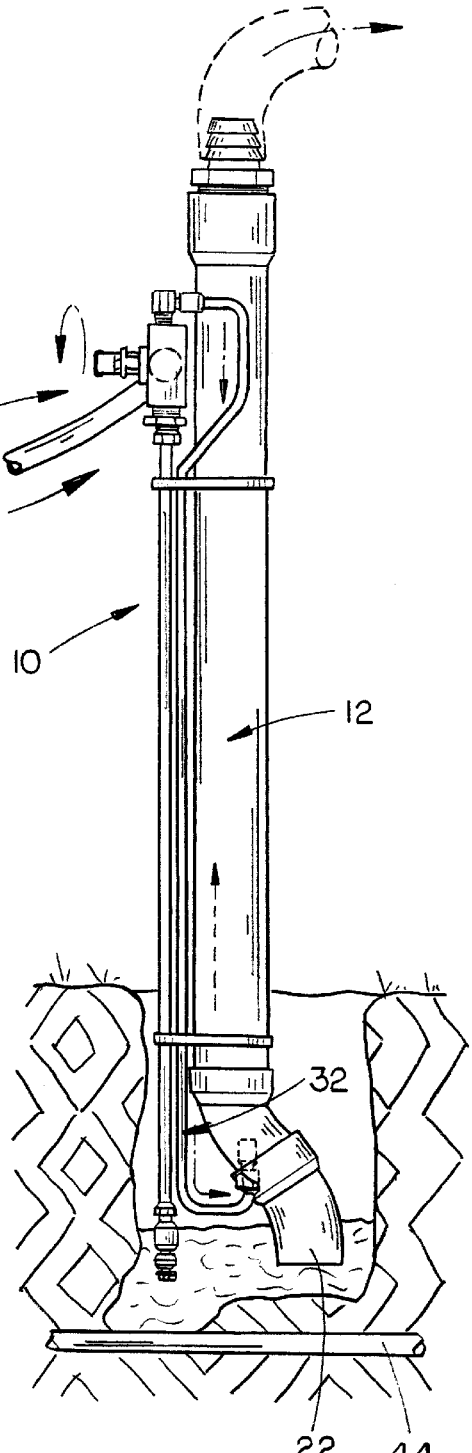
FIG. 4 is a view similar to FIG. 3 except that the mud is being evacuated from the hole.
Figure 5:
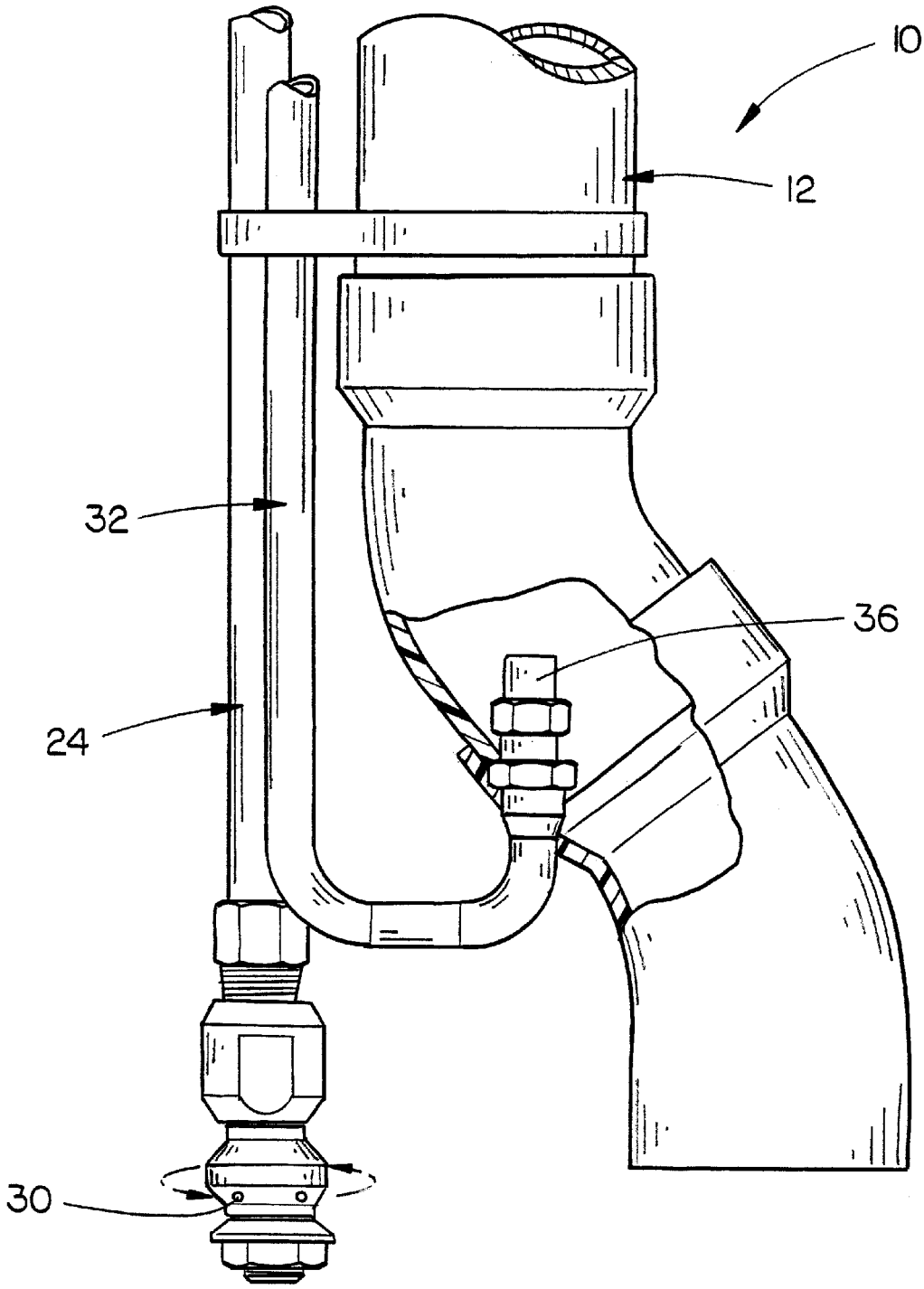
FIG. 5 is a partial side view of the lower end of the device with portions thereof cut away to more fully illustrate the invention.

When it is desired to expose a buried object such as a utility line or cable 44, a pot-hole or daylight hole is initially dug into the ground with a shovel or the like. The purpose of starting the hole with a shovel is to contain the discharging water within the hole and to avoid splashing mud onto the operator of the device. The operator then activates two-way valve 38 so that water under high pressure is discharged from the nozzle 30 to loosen soil within the hole, as seen in FIG. 3. When the hole is partially or substantially filled with mud, the two-way valve 38 is operated to close line 24 and to open line 22 (FIG. 4). The water passing downwardly through water supply line 32 and upwardly into the tube 12 causes a suction or vacuum at the lower end of the tube 12 to suck or vacuum the muddy water from the hole upwardly through the tube 12, hose 18, and into the container 20. The digging (loosening) and vacuuming operation is repeated until the hole has been sufficiently dug downwardly to expose the utility line 44. It can therefore be seen that a novel hand-held device has been disclosed for exposing buried objects such as utility lines or the like which may be operated by a single person and which will not damage the utility line.

Thus it can be seen that the invention accomplishes at least all of its stated objectives.

I claim:

1. A hand-held device for exposing buried objects, comprising:

an elongated, hollow outermost tube having upper and lower ends;

a first water supply conduit positioned adjacent said outermost tube and having an intake end and a discharge end;

said discharge end of said water supply conduit being positioned laterally outwardly of said lower end of said outermost tube and having a digging nozzle mounted thereon which may be brought into close proximity with the earth;

a second water supply line positioned adjacent said outermost tube and having an intake end and a discharge end;

said discharge end of said second water line being directed upwardly into said outermost tube adjacent said lower end thereof;

a mud take-off conduit in fluid communication with said upper end of said outermost tube;

a valve having intake and discharge sides;

said discharge side of said valve being in selective fluid communication with the said intake end of said first or second water supply conduits;

said intake side of said valve being in fluid communication with a high pressure water pump.

2. The device of claim 1 wherein said valve comprises a two-way valve.

3. The device of claim 1 wherein said mud take-off conduit is in fluid communication with a mud recovery container.

4. The device of claim 1 wherein said outermost tube has a hollow laterally offset portion at its lower end.

5. The device of claim 4 wherein said discharge end of said second water supply line is directed upwardly into said offset portion.

6. The device of claim 5 wherein said discharge end of said second water supply line is substantially aligned with the center axis of said outermost tube.

7. The device of claim 4 wherein said offset portion has a lower end and wherein said discharge end of said second water supply line is directed upwardly into said offset portion above said lower end thereof.

8. device of claim 1 wherein said outermost tube is comprised of a rigid plastic material.

9. The device of claim 1 wherein said first and second water supply lines are positioned adjacent the exterior surface of said outermost tube.

10. A hand-held device for exposing buried objects, comprising:

an elongated, hollow outermost tube having upper and lower ends;

a first water supply conduit having an intake end and a discharge end;

said discharge end of said water supply conduit being positioned laterally outwardly of said lower end of said outermost tube and having a digging nozzle mounted thereon which may be brought into close proximity with the earth;

a second water supply line having an intake end and a discharge end;

said discharge end of said second water line being directed upwardly into said outermost tube adjacent said lower end thereof;

a mud take-off conduit in fluid communication with said outermost tube above the lower end thereof;

a valve having intake and discharge sides;

said discharge side of said valve being in selective fluid communication with the said intake end of said first or second water supply conduits;

said intake side of said valve being in fluid communication with a high pressure water pump.

11. The device of claim 10 wherein said valve comprises a two-way valve.

12. The device of claim 10 wherein said mud take-off conduit is in fluid communication with a mud recovery container.

13. The device of claim 10 wherein said outermost tube has a hollow laterally offset tube portion at its said lower end.

14. The device of claim 13 wherein said discharge end of said second water supply line is directed upwardly into said offset tube portion.

15. The device of claim 14 wherein said discharge end of said second water supply line is substantially aligned with the center axis of said outermost tube.

16. The device of claim 13 wherein said offset portion has a lower end and wherein said discharge end of said second water supply line is directed upwardly into said offset portion above said lower end thereof.

17. The device of claim 10 wherein said outermost tube is comprised of a rigid plastic material.

18. The device of claim 10 wherein said first and second water supply lines are positioned adjacent the exterior surface of said outermost tube.

* * * * *